United States Patent [19]

Deaton

[11] 4,140,153

[45] Feb. 20, 1979

[54] SUBSURFACE SAFETY VALVE

[75] Inventor: Thomas M. Deaton, Dallas, Tex.

[73] Assignee: Otis Engineering Corporation, Dallas, Tex.

[21] Appl. No.: 794,410

[22] Filed: May 6, 1977

[51] Int. Cl.[2] ..... F16K 11/16; E21B 43/12

[52] U.S. Cl. ..... 137/629; 166/324

[58] Field of Search ..... 137/629; 166/324

[56] References Cited

U.S. PATENT DOCUMENTS 3,854,502 12/1974 Mott ..... 137/629

*Primary Examiner*—Robert G. Nilson

*Attorney, Agent, or Firm*—Vinson & Elkins

[57] ABSTRACT

A surface controlled subsurface safety valve having a main valve and an equalizing valve. The equalizing valve is opened prior to the opening of the main valve. An extra control pressure force is provided to open the equalizing valve against the resistive force present due to high shut-in formation pressures. On the other hand, the safety valve can close when low subsurface pressure conditions exist at the valve. This abstract is neither intended to define the scope of the invention, which, of course, is measured by the claims, nor is it intended to be limiting in any way.

13 Claims, 9 Drawing Figures

SUBSURFACE SAFETY VALVE

BACKGROUND OF THE INVENTION

A. Field of the Invention

This invention relates to a surface controlled subsurface safety valve for controlling flow at a subsurface location in a well. The subsurface safety valve includes a main valve member. When the safety valve is open, the main valve member provides a full open bore flow path through the safety valve. Prior to movement of the main valve member to its open bore position, an equalizing valve is opened to equalize pressures across the main valve member.

B. The Prior Art

Surface controlled subsurface safety valves having both a main valve member and an equalizing valve are disclosed in United States Letters Pat. Nos. 3,583,442 and 3,703,193. For the safety valves disclosed in such patents, the equalizing valve opens prior to movement of the main valve member to its open position. If the shut-in, downhole well pressure is high, the force required to open the equalizing valve will be much greater than the force required to move the main valve member between its closed and open positions once the equalizing valve is opened. Control fluid will have to be pressurized to a pressure greater than the pressure of the shut-in well fluids to open the equalizing valve. Thereafter, that same high control fluid pressure will act to quickly move the main valve member to its open position. Such quick movement could cause damage to the valve.

An emergency condition may be created in the well if the surface well head is damaged. Under such an emergency condition, the well would flow freely due to an absence of surface controls. If surface controls are rendered inoperative and the well does begin to flow freely, subsurface safety valves will be relied upon to shut in the well. However, under such emergency conditions, with well fluids flowing freely through the subsurface safety valve, the well pressure sensed at the subsurface safety valve approaches zero. Little or no force is provided by the freely flowing well fluids to assist closure of the subsurface safety valve. The spring, or other inherent resilient urging means, is relied upon to supply the force required to close the subsurface safety valve. That spring force presently has to move a relatively large volume of control fluid out of a control pressure chamber into a control conduit. Forces, due to the hydrostatic head of control fluid within the control conduit, resist that movement of control fluid and thereby retard closure of the subsurface safety valve.

OBJECTS OF THE INVENTION

An object of this invention is to provide a surface controlled subsurface safety valve with variable control pressure responsive areas.

Another object of this invention is to provide a surface controlled subsurface safety valve with a large control pressure responsive area for opening the equalizing valve of the safety valve and with a small control pressure responsive area for opening the main valve of the safety valve.

Another object of this invention is to provide a surface controlled subsurface safety valve with a variable control pressure responsive area so that a small area is affected by control fluid resistive forces during valve closure.

Another object of this invention is to provide a surface controlled subsurface safety valve with a floating piston which assists movement of an equalizing valve to an open position but which does not retard closure of the safety valve.

These, other objects, and features of advantage of this invention will be apparent from the drawings, the detailed description, and the appended claims.

BRIEF DESCRIPTION OF THE DRAWINGS

In the drawings, wherein like numerals indicate like parts, and wherein illustrative embodiments of this invention are shown.

DETAILED DESCRIPTION OF THE PREFERRED EMBODIMENTS

Figure 9:
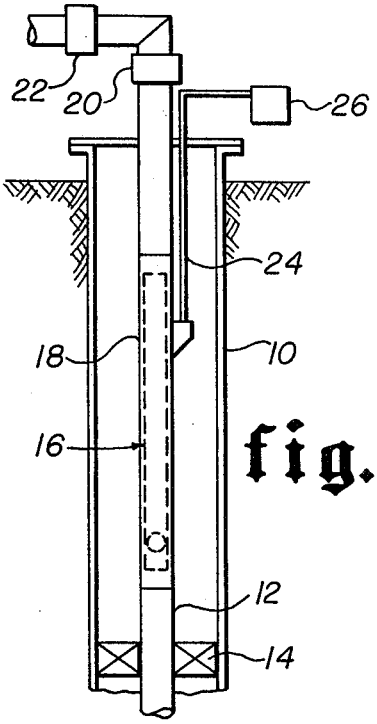
FIG. 9 is a schematic illustration of a well installation incorporating this invention.
Figure 8:
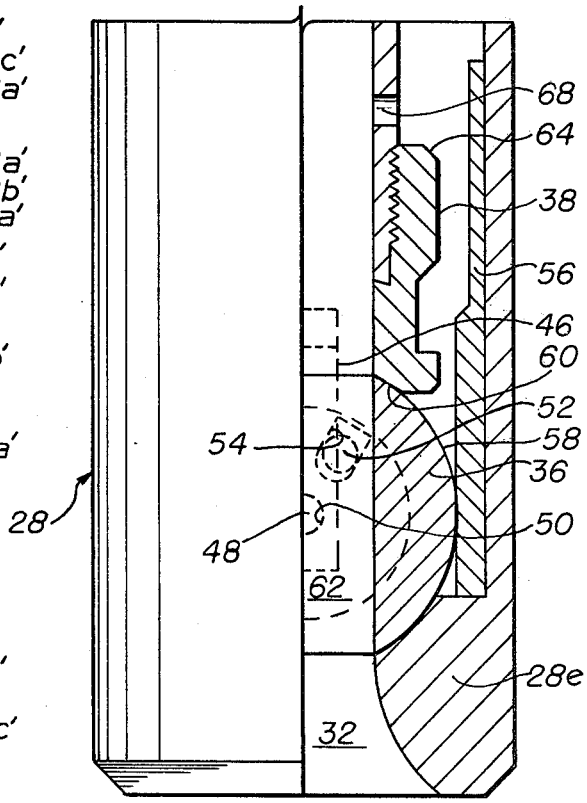
FIG. 8 is a quarter-sectional view of the lower portion of the valve of FIG. 1 taken at right angles to the view in FIG. 1.

A typical well installation incorporating this invention is illustrated schematically in FIG. 9. The well is cased with the usual casing string 10. Through the casing string 10 extends a production tubing string 12. Fluid flow from a producing formation (not shown) is confined to the bore of the tubing string 12 by packing off the annulus between the casing string 10 and the tubing string 12 with packer means 14. Subsurface safetyvalve 16 (indicated in dotted form in FIG. 9) is positioned in the tubing string 12 by landing, locking and sealing it in a landing nipple 18 in the tubing string 12. Flow through the tubing string 12 is controlled at a subsurface location by subsurface safety valve 16 and at a surface location by surface valves 20 and 22. The subsurface safety valve 16 is controlled from the surface by communicating control fluid thereto through control conduit means 24. At the surface, operating manifold 26 pressurizes and depressurizes the control fluid and pumps it into control conduit means 24. When control conduit means 24 is pressurized, the subsurface safety valve 16 opens the subsurface flow path through the bore of the production tubing string 12. When control conduit means 24 is depressurized, the subsurface safety valve 16 prevents flow through the subsurface flow path.

The detailed structure of a first embodiment of a subsurface safety valve 16 is illustrated in FIGS. 1 through 6 and 8. The illustrated embodiment is a wire line retrievable, surface controlled subsurface safety valve. Those skilled in the art could easily adapt such a valve to be tubing retrievable or useable with pump-down equipment.

The subsurface safety valve 16 comprises housing means 28 for defining the subsurface flow path, closure means which normally prevents flow through the subsurface flow path, and control pressure responsive means for moving the closure means to a position permitting flow through the subsurface flow path when affected by pressurized control fluid.

Valve housing means 28 carries packer means 30. Packer means 30 seals between the interior wall of the tubing string landing nipple 18 and valve housing means 28 when the subsurface safety valve 16 is landed within the landing nipple 18. When packer means 30 is effective, subsurface flow through the tubing string 12 is confined to the bore 32 of valve housing means 28. To the upper end of valve housing means 28 is connected a locking mandrel 34 (only a portion of which is shown) which locks the subsurface safety valve 16 into the landing nipple 18. Valve housing means 28 is formed from interconnected tubular sections 28*a*, 28*b*, 28*c*, 28*d* and 28*e*.

Closure means controls flow through the housing bore 32. Closure means includes main valve member means 36 which is movable between a bore closing position (see FIGS. 1 and 2) and a full, open bore position (see FIG. 3). Closure means also includes equalizing valve means 38 which is movable between a position preventing flow (see FIG. 1) and a position permitting flow around main valve member means 36 (see FIG. 2). The closure means has three operating positions. In its first position (see FIG. 1), both the main valve member means 36 and equalizing valve means 38 present flow through the housing bore 32. In its second position (see FIG. 3), main valve member means 36 is in a full open bore position. Additionally, equalizing valve means 38 is open. However, most of the fluid flow will occur through the full open bore through main valve member means 36. During movement of the closure means from its first position to its second position, there is an intermediate position (see FIG. 2). At this intermediate position, the main valve member means 36 is still in its bore closing position. However, equalizing valve means 38 is open and permits flow around main valve member means 36. The fluid flow equalizes fluid pressures on both sides of main valve member means 36. Movement of main valve member means 36 to its full open bore position is accomplished much easier once pressure equalization has occurred.

Operator means 40 moves the closure means between its first and second positions. Operator means 40 is disposed within the housing bore 32 and is axially movable with respect to valve housing means 28 between its first, upward position (see FIG. 1) wherein the closure means is also in its first position and its second, downward position (see FIG. 3) wherein the closure means is in its second position. During movement of the operator means 40 from its first to its second position, it also has an intermediate position (see FIG. 2) wherein the closure means is in its intermediate position. Operator means 40 comprises abutting sleeve sections 40*a* and 40*b*. The sleeve sections 40*a* and 40*b* are disposed in the housing bore 32 in such a manner that an annulus 42 is formed between operator means 40 and valve housing means 28. Extending through the sleeve sections 40*a* and 40*b* is a fluid flow path 44 through which well fluids flow when the subsurface safety valve 16 is open.

The subsurface safety valve 16 includes means for mounting the closure means. The mounting means cooperates with operator means 40 to move and maintain the closure means in its first, intermediate or second position depending upon the respective position of operator means 40.

The illustrated main valve member means 36 is a ball valve closure element. It moves axially with respect to valve housing means 28 during a corresponding axial movement of operator means 40. During axial movement of operator means 40 from its first position to its intermediate position, main valve member means 36 simply moves axially with respect to valve housing means 28. It does not rotate during that axial movement. During movement of operator means 40 from its intermediate position to its second position, main valve member means 36 moves axially and rotates from its bore closing position to its full open bore position. To move main valve member means 36 axially with respect to valve housing means 28, main valve means 36 is mounted on finger means 46. Finger means 46 are associated with operator means 40 and move substantially therewith. Although only one such finger means 46 is shown in the drawings, two opposed finger means 46 would be disposed on opposite sides of main valve member means 36. Each finger means 46 includes opposed pin means 48 which project into pivot bore means 50 of main valve member means 36. To rotate main valve member means 36, opposed pivot pin means 52 engage pivot slot means 54 which are formed in opposite sides of main valve member means 36. During movement of main valve member means 36 from the intermediate position of the closure means to the second position of closure means, pivot pin means 52 are stationary. The axial movement of main valve member means 36 with respect to the stationary pivot pin means 52 results in a movement arm being produced which rotates main valve member means 36. During axial movement of main valve member means 36 from the first position of closure means to the intermediate position of closure means, pivot pin means 52 also move axially with respect to valve housing means 28. Therefore, no moment arm is imparted to rotate main valve member means 36. Pivot pin means 52 are formed on lost motion sleeve 56. Lost motion sleeve 56 is movable with respect to housing means 28 between a first position (see FIG. 1) and a second position (see FIGS. 2, 3, and 8). Lost motion sleeve 56 is in its first position when the closure means is in its first position. Lost motion sleeve 56 is moved to its second position when the closure means is moved to its intermediate position. Thereafter, lost motion sleeve 56 remains in its second position during movement of the closure means from its intermediate position to its second position.

As a rotatable ball closure element, main valve member means 36 includes an outer spherical sealing surface 58 which sealingly engages coacting seat means 60. This sealing engagement prevents flow past main valve member means 36 whenever it is in its bore closing position. Main valve members means 36 also includes a passage means 62 extending therethrough. Passage means 62 is aligned with the flow path 44 through the operator sections 40*a* and 40*b* and the housing bore 32 whenever main valve member means 36 is in its full open bore position (see FIG. 3).

Equalizing valve means 38 moves from its position preventing flow to its position permitting flow during movement of operator means 40 from its first to its intermediate position. As shown, equalizing valve means 38 is associated with operator means 40 and moves axially therewith.

Figure 1:
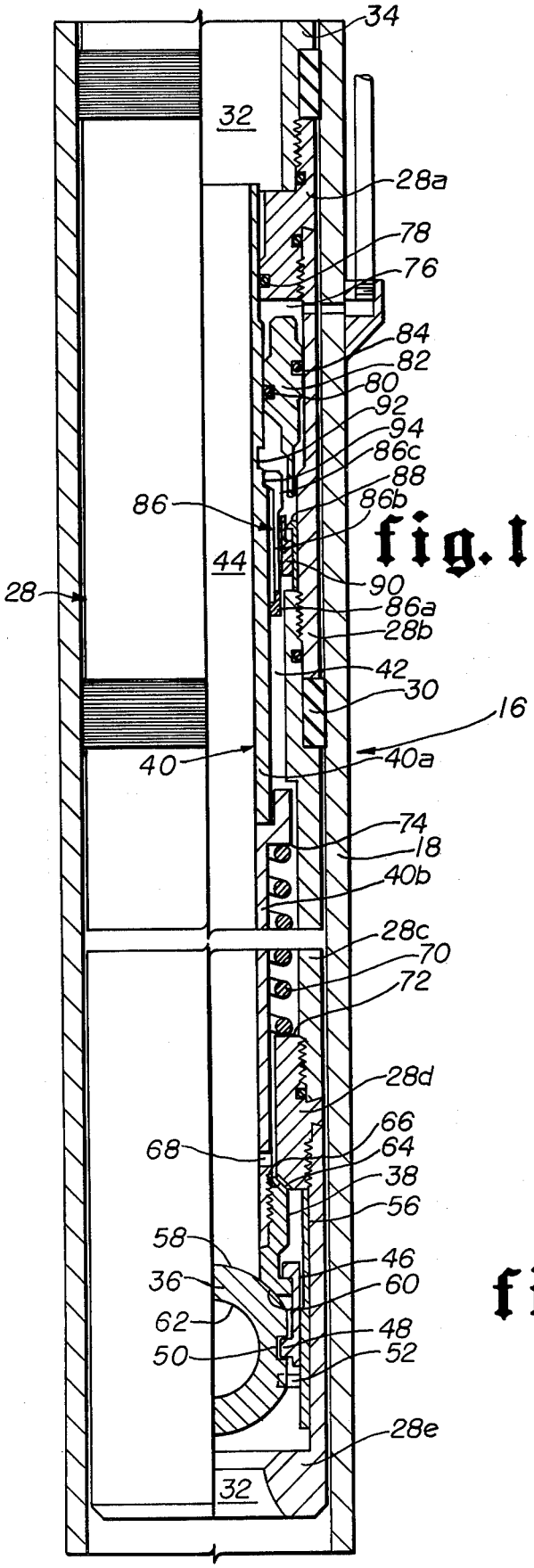
FIG. 1 is a quarter-sectional view of a subsurface safety valve in accordance with this invention with the valve closed.
Figure 2:
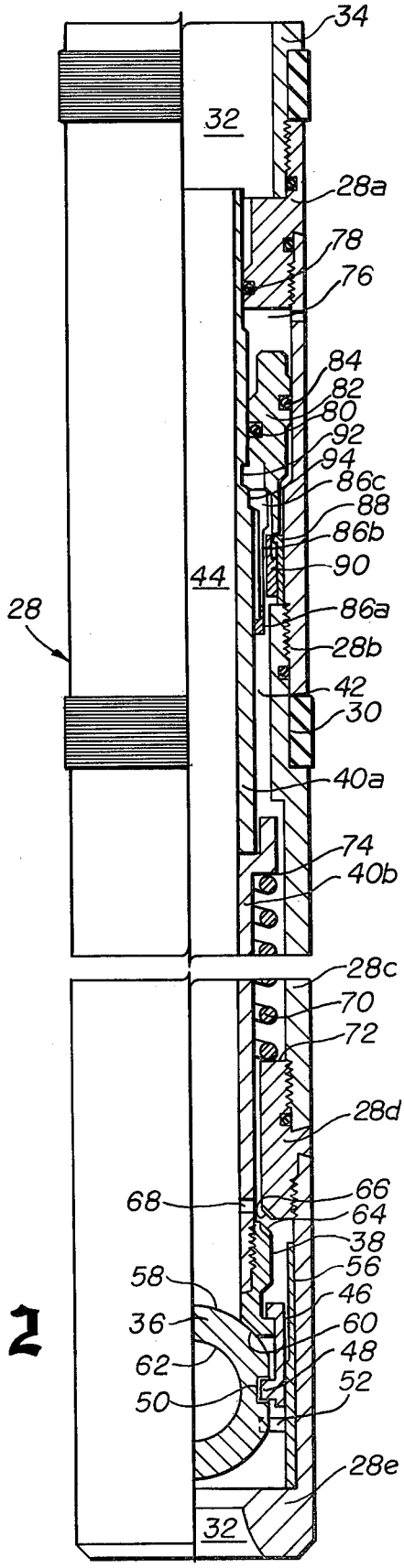
FIG. 2 is a quarter-sectional view of the valve of FIG. 1 with the equalizing valve open.
Figure 3:
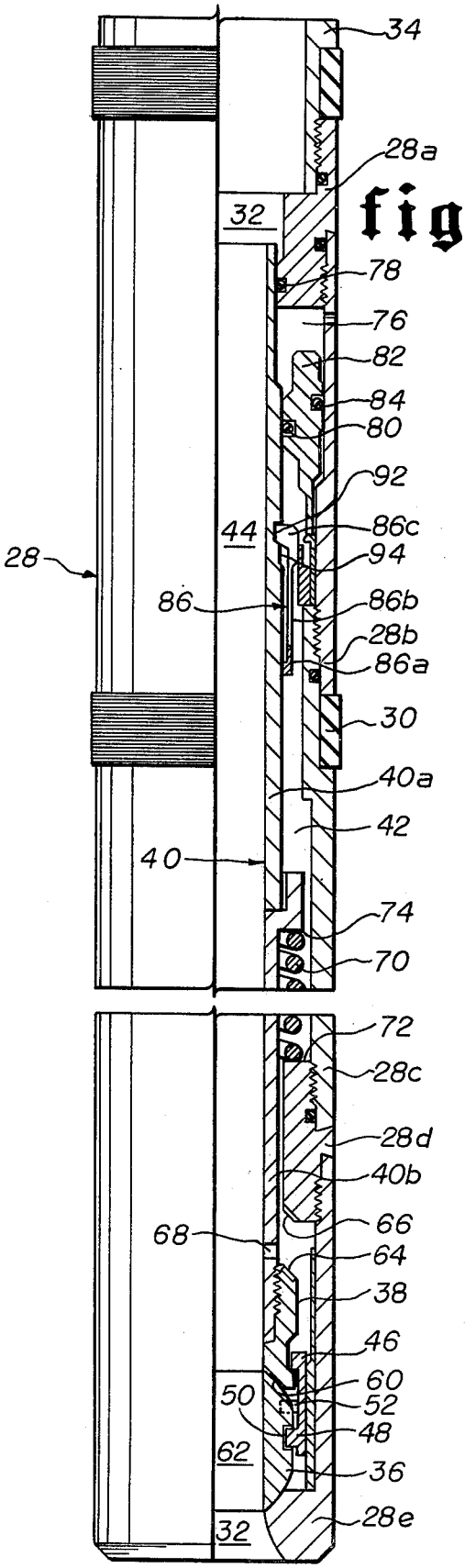
FIG. 3 is a quarter-sectional view of the valve of FIG. 1 with the equalizing valve and the main valve opened.

Equalizing valve means 38 includes an annular metal-to-metal sealing surface 64 which engages a corresponding metal-to-metal sealing surface 66 formed on tubular housing section 28*d* when the closure means is in its first position (see FIG. 1). Operator means 40 includes port means 68 above the seating surface 64 of annular valve means 38. When the respective metal-to-metal sealing surfaces 66 and 64 are spaced (see FIG. 2), fluid flow through port means 68 is permitted. When the closure means is in its intermediate position and flow is permitted by the equalizing valve means 38 through port means 68, well fluid pressures can be equalized across the still closed main valve member means 36. The equalization of pressures across main valve member means 36 enables it to be moved to its full open bore position without a fluid pressure differential existing thereacross during such movement.

For returning the closure means to its normally closed position, means, such as spring means 70, resiliently urge operator means 40 to its first position. Spring means 70 is disposed between an upwardly facing shoulder 72 of valve housing means 28 and a downwardly facing shoulder 74 of operator means 40. Spring means 70 is a coil compression spring.

Control pressure responsive means moves the closure means to its second position whenever control fluid is pressurized a sufficient amount. In accordance with this invention, the control pressure responsive means has two pressure responsive areas. A large pressure responsive area is affected by control fluid pressure during opening of the equalizing valve means 38. A portion of that large pressure responsive area is thereafter rendered ineffective. Instead, only a small pressure responsive area is affected by control pressure during opening of the main valve member means 36. The ineffective portion of the large pressure responsive area does not resist movement of the closure means from its second position to its first position. Only the small pressure responsive area resists such movement of the closure means.

The control pressure responsive means includes control pressure chamber means 76 formed in the annulus 42 between operator means 40 and housing means 28. Whenever control fluid within control chamber means 76 is pressurized a sufficient amount, operator means 40 is moved to its second position. Whenever the pressure of control fluid within control pressure chamber means 76 is reduced below a sufficient amount, spring means 70 moves operator means 40 to its first position.

A first, small pressure responsive area for moving operator means 40 from its first position to its second position is associated with operator means 40. The first pressure responsive area comprises a primary piston means and defines a portion of control pressure chamber means 76. The first pressure responsive area of primary piston means is defined by the difference between the seal effective areas of seal means 78 and seal means 80. First seal means 78 is carried by tubular housing section 28*a* and seals between valve housing means 28 and operator means 40. Its seal effective area is defined by the circular area within its inside diameter. Second seal means 80 is carried by floating piston means 82 and seals between floating piston means 82 and operator means 40. Its seal effective area is defined by the circular area within its inside diameter. Since the inside diameter of second seal means 80 is greater than the inside diameter of first seal means 78, a downward force on operator means 40 is produced whenever control pressure chamber means 76 is pressurized. The downward force equals the pressure of the control fluid within control pressure chamber means 76 times the difference between the second seal effective area of second seal means 80 and the first seal effective area of first seal means 78.

The control pressure responsive means also includes floating piston means 82. Floating piston means 82 assists movement of operator means 40 from its first position to its intermediate position. Floating piston means 82 is disposed in the annulus 42 between operator means 40 and valve housing means 28 and defines a portion of pressure chamber means 76. Floating piston means 82 is associated with operator means 40 during movement of operator means 40 from its first position to its intermediate position. Floating piston means 82 is disassociated from operator means 40 during movement of operator means 40 from its intermediate position to its second position. Floating piston means 82 is also disassociated with operator means 40 during movement of operator means 40 from its second position to its first position. Therefore operator means 40 is moved from its intermediate position to its second position due to pressurized control fluid being effective across the first, small pressure responsive area. Additionally, any forces which may be produced by residual control fluid and which tend to retard upward movement of operator means are effective across only the small pressure responsive area of the primary piston means.

The pressure effective area of floating piston means 82 comprises the difference between the third seal effective area of third seal means 84 and the second pressure effective area of second seal means 80. Therefore, when floating piston means 82 is associated with operator means 40, the large pressure responsive area of the control pressure responsive means comprises the difference between the third seal effective area of third seal means 84 and the first seal effective area of first seal means 78.

Various means cooperate so that floating piston means 82 is rendered effective to assist movement of operator means 40 from its first position to its intermediate position, is rendered ineffective to assist movement of operator means 40 from its intermediate position to its second position, and is prevented from affecting movement of operator means 40 from its second position to its first position. Means 86 selectively engage together operator means 40 and floating piston means 82 during movement of operator means 40 from its first position to its intermediate position. Because of the selective engaging means 86, floating piston means 82 is rendered effective to assist that movement of operator means 40. At that intermediate position of operator means 40, means 88 disengage at least one of the floating piston means 82 and operator means 40 from the selective engaging means 86.

Floating piston means 82 is rendered ineffective to retard movement of operator means 40 from its second position to its first position due to means 90 preventing the selective engaging means 86 from reengaging said one of the operator means 40 and the floating piston means 82 during movement of operator means 40 from its second position to its first position.

The selective engaging means 86 may comprise the collet means 86 illustrated. Collet means 86 is disposed in the annulus 42 between operator means 40 and housing means 28 and is adapted to move axially therein. It includes a web portion 86*a*, spring fingers 86*b*, and enlarged collet heads 86*c* at the ends of the spring fingers 86*b*. The spring fingers 86*b* bias the collet heads 86*c* radially outwardly. During axial movement of operator means 40 with respect to valve housing means 28, the collet heads 86*c* selectively engage operator means 40 and floating piston means 82. That selective engagement causes collet means 86 to also move axially with respect to valve housing means 28.

For engaging the collet heads 86*c*, operator means 40 includes outer stepped recess means. The stepped recess means has a first recess step 92 of a first outside diameter and a second recess step 94 of a second outside diameter. It will be noted that the outside diameter of first recess step 92 is less than the outside diameter of second recess step 94.

For selectively engaging the collet heads 86*c*, floating piston means 82 includes inwardly facing stepped shoulder means. The stepped shoulder means have a first shoulder 96 of a first inside diameter and a second shoulder 98 of a second inside diameter. The inside diameter of first shoulder 96 is less than the inside diameter of second shoulder 98.

The thickness and length of the collet heads 86*c*, the diameters of the recess steps 92 and 94 and the diameters and lengths of the shoulders 96 and 98 are all sized for selective co-engagement among collet means 86, operator means 40 and floating piston means 82. When the collet heads 86*c* engage the second step 94, they are received radially within the second shoulder 98 of floating piston means 82. The inclined surface 100 of floating piston means 82, which extends between the first shoulder 96 and the second shoulder 98, therefore engages the collet heads 86*c*. That engagement permits corresponding downward movement of floating piston means 82, collet means 86 and operator means 40 when control pressure chamber means 76 is pressurized. When the collet heads 86*c* are confined within the first step 92 of operator means 40, they will not engage the tapered surface 100 and they may become disposed radially within the first shoulder 96 of floating piston means 82 (see FIG. 6).

Floating piston means 82 is effective to assist only the downward movement of operator means 40 from its first position to its intermediate position. Stop means 88 engages the lower end 82*a* of floating piston means 82 and halts its further axial movement when operator means 40 reaches its intermediate position. With floating piston means 82 stopped, collet means 86 disengages therefrom during continued movement of operator means 40 to its second position.

Collar means 90 prevents collet means 86 from reengaging floating piston means 82 during movement of operator means 40 from its second position to its first position. Collar means 90 is disposed in the annulus 42 and is axially movable therein with respect to valve housing means 28. The inside diameter of collar means 90 is such that when the collet heads 86*c* are disposed radially therein, they are confined inwardly. The inward confinement of the collet heads causes them to engage the first step 92 of operator means 40 and permits them to be received radially within the first inwardly facing shoulder 96 of floating piston means 82. The collet heads 86*c* becomes disposed radially within collar means 90 during movement of operator means 40 to its second position (see FIG. 3). The outwardly biased collet heads 86*c* engage collar means 90. Upon movement of operator means upwardly to its first position, the engagement of the collet heads 86*c* with collar means 90 causes collar means 90 to move axially with collet means 86. Collar means 90 moves axially upwardly a distance sufficient to prevent the collet heads 86*c* from springing radially outwardly and engaging the second inwardly facing shoulder 98 of floating piston means 82. During the entire upward axial movement of operator means 40, the collet heads 86*c* are confined inwardly and are held in the first stepped recess 92 of operator means 40. The collet heads 86*c* may be confined inwardly during such movement solely by collar means 90. Alternatively, collar means 90 may confine the collet heads 86*c* inwardly during a portion of such movement. During that portion of the upward movement of operator means 40, the collet heads 86*c* will become disposed radially within the first inwardly facing shoulder 96 of floating piston means 82. During the remaining portion of the upward movement of operator means 40, shoulder 96 confines the collet heads 86*c* inwardly. In either case, the collet heads 86*c* do not engage a downwardly facing shoulder or the main body portion of floating piston means 82 during the entire upward movement of operator means 40. Floating piston means 82 is thereby disassociated from operator means 40 during upward axial movement of the latter. Except for frictional forces due to the engagement of the collet heads 86*c* and the floating piston's first shoulder 96, no axial forces are imparted to operator means by floating piston means 82 during upward movement of operator means 40.

In operation, the subsurface safety valve 16 of this invention may be utilized to control flow at a subsurface location in a well. The flow is controlled in response to pressurizing control fluid at a surface location.

In an absence of control fluid pressure, the subsurface safety valve 16 prevents subsurface fluid flow. The resilient urging spring means 70 moves operator means 40 to its first upward position. Operator means 40 in turn moves valve closure means, including main valve member means 36 and equalizing valve means 38, to their respective positions preventing flow through the subsurface flow path defined by the housing bore 32 (see FIG. 1).

With the subsurface safety valve 16 closed, the pressures from the producing formation will be exerted across the valve closure means. This shut-in well pressure may become quite high. The pressure will be effective across the entire area of the valve's closure means. Although the shut-in well pressure has the beneficial effect of forcing both the main valve member means 36 and annular valve means 38 into a tighter sealing engagement, the shut-in well pressure also resists movement of both main valve member means 36 and annular valve means 38 to their open position.

When it is desired to open the subsurface flow path, operating manifold 26 pumps control fluid into control conduit means 24. Control pressure chamber means 76 becomes pressurized with control fluid. The pressurized control fluid is effective across the first pressure responsive area between second seal means 80 and first seal means 78 and is also effective across floating piston means 82. Since, initially, there is little resistance to downward axial movement of floating piston means 82, it will move downwardly unitl its tapered surface 100 engages the collet head 86*c*.

Thereafter, continued pressurization of fluid within control pressure chamber means 76 will render both the first pressure responsive area and floating piston means 82 effective to move operator means 40 downwardly from its first position. The collet heads 86c will be engaged by the downwardly facing tapered surface 100 of floating piston means 82 and an upwardly facing shoulder 102 which defines the second stepped recess 94 of operator means 40. That engagement renders floating piston means 82 effective to assist downward movement of operator means 40. Upon a sufficient pressurization of control pressure chamber means 76, operator means 40 is moved downwardly towards its second position. A large pressure responsive area is effective to move operator means downwardly. When operator means 40 reaches its intermediate position, equalizing valve means 38 is opened. The metal-to-metal sealing surfaces 64 and 66 are spaced and flow is permitted from the housing bore 32 below main valve member means 36 through port means 68 to the housing bore 32 above main valve member means 36 (see FIG. 2). Well fluid pressures across main valve member means 36 may thereby be equalized. Due to the axial movement of lost motion frame 56, no moment arm is imparted to main valve member means 36 during that initial movement of operator means 40. Forces resisting downward movement of operator means 40, due to shut-in formation pressure, will be greatest during that initial movement of operator means 40. The extra pressure responsive area, provided by floating piston means 82 assists the downward movement of operator means 40 when that assistance is most desired.

When operator means 40 attains its intermediate position and opens equalizing valve means 28, floating piston means 82 is rendered ineffective to further assist downward movement of operator means 40. At that time, the lower end 82a of floating piston means 82 engages stop means 88. Further downward movement of floating piston means 82 is prevented.

Most likely, after floating piston means 82 has been rendered ineffective for assisting downward movement of operator means 40, the pressure of control fluid within control pressure chamber means 76 will have to be increased to continue the downward movement of operator means 40. Thus, a positive signal to the surface operator is provided when equalizing valve means 38 is opened. A first pressure, which has been effective across a large differential pressure responsive area, has moved operator means 40 downwardly from its first position to its intermediate position. Due to the sudden conversion to a much smaller pressure responsive area, a second pressure will continue the movement of operator means 40 to its second position.

During the continued downward movement of operator means 40, the collet heads 86c will engage the downwardly facing surface 104 which defines the upper end of the operator's first recess step 92. Collet means 86 will thereby be moved downwardly with operator menas 40. During that downward movement, the collet heads 86c will become confined radially within collar means 90 (see FIG. 3).

Completion of the movement of operator means 40 to its second position, results in the movement of main valve member means 36 to its full open bore position. Its passage means 62 is aligned with the housing bore 32. Fluids may flow unrestricted through the housing bore 32, main valve passage means 62, and the flow path 44 through operator means 40 (see FIG. 3).

The full open bore position of main valve member means 36 will be maintained as long as the pressure within the control pressure chamber means 76 does not fall below a sufficient amount. When control pressure within control pressure chamber means 76 falls below that sufficient amount, for whatever reason, valve closure is initiated. The resilient urging spring means 70 will return operator means 40 to its first position thereby returning the closure means to its position preventing flow through the subsurface flow path. During movement of operator means 40 from its second position to its first position, floating piston means 82 is prevented from being associated with operator means 40 and retarding such movement.

The subsurface safety valve 16 is designed so that the forces which retard valve closure and which are due to a hydrostatic head of fluid in control conduit means 24 are reduced. With those closure retarding forces reduced, valve closure is swifter and is move assured. Assured valve closure is attained even in the absence of well fluid pressures within the safety valve. Well fluid pressures normally assist valve closure. This valve 16, which can close without such well pressure assistance, therefor provides an operational advantage over present subsurface safety valves. Swift and assured valve closure, which can be attained in the absence of assisting well fluid pressure, is highly desirable to protect a well in the event that the surface controls are rendered inoperative.

During closure of the subsurface safety valve 16, fluid within control pressure chamber means 76 will be forced into control conduit means 24. The hydrostatic head of fluid within control conduit means 24 will resist that fluid movement. To reduce the hydrostatic fluid forces resisting valve closure, the pressure responsive area affecting movement of operator means 40 is reduced and the volume of displaced control fluid is reduced. During closure of the subsurface safety valve 16, floating piston means 82 remains stationary and dissassociated from operator means 40. Floating piston means 82 therefore does not provide a pressure responsive area which affects movement of operator means 40 and does not attempt to force control fluid out of control pressure chamber means 72. Only the first, small pressure responsive area affects upward movement of operator means 40 and displaces control fluid out of control pressure chamber means 72. All of the hydrostatic fluid forces resisting valve closure are thereby reduced. The hydrostatic pressure force is reduced because the pressure acts across a smaller area than has heretofore been the practice. The inertia of the hydrostatic head of the control fluid resists control fluid movement in porportion to the volume of the fluid that is moved. Since the volume of moved fluid is reduced, the inertia resistive force is reduced. Additionally, there is a frictional force created as the control fluid moves in the control conduit means 24. That frictional force is also proportional to the volume of the displaced control fluid. With the safety valve 16, the frictional force is also reduced vis-a-vis present subsurface safety valves.

Figure 4:
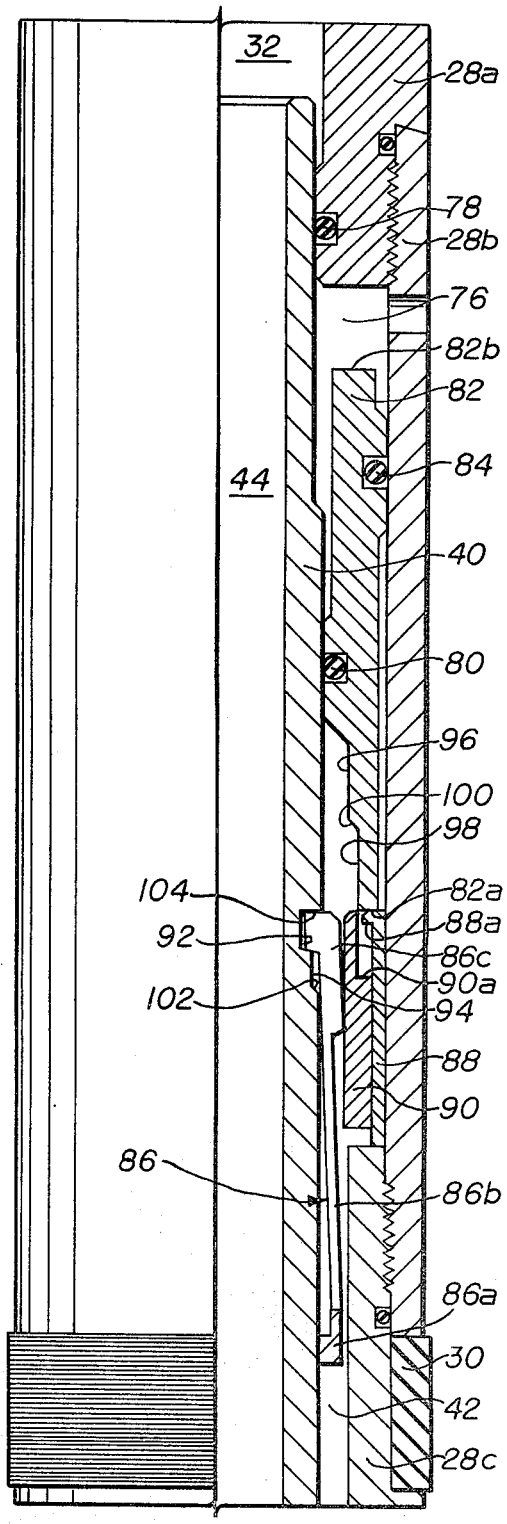
FIG. 4 is an enlarged view of the upper portion of the valve of FIG. 1 illustrating a sequential step in valve closure.
Figure 5:
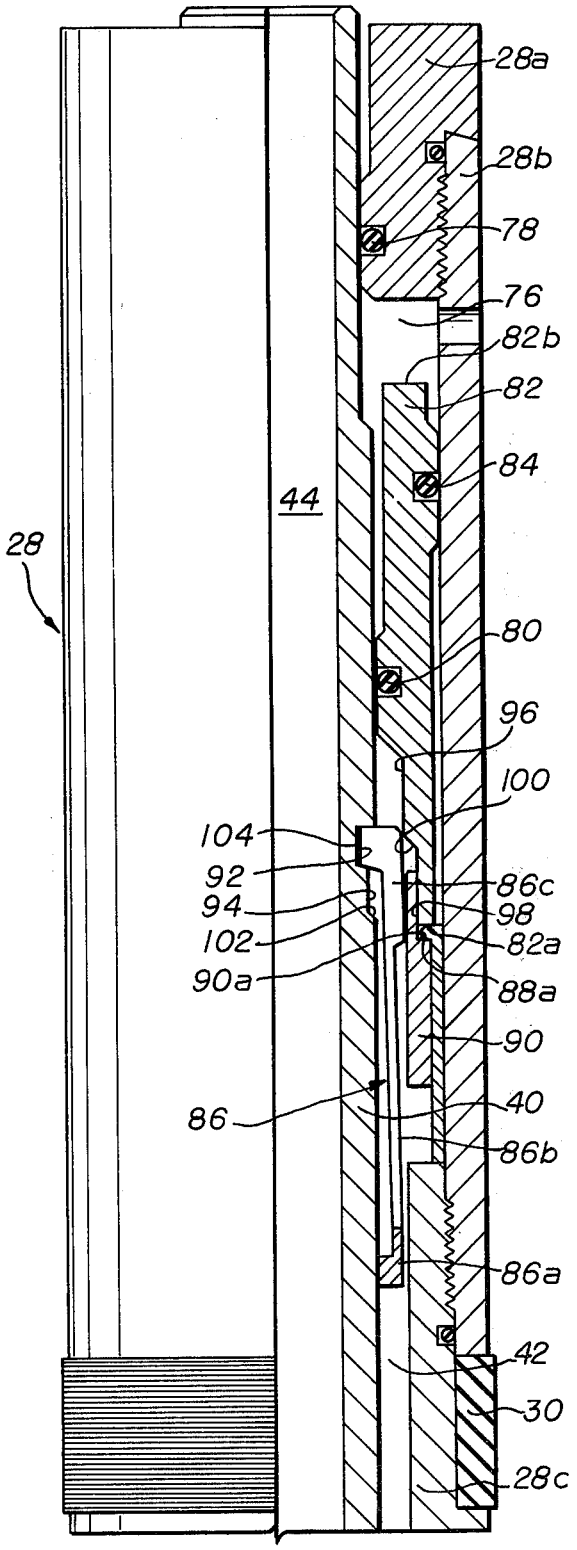
FIG. 5 is another view of the upper portion of the valve of FIG. 1 illustrating another sequential step in valve closure.
Figure 6:
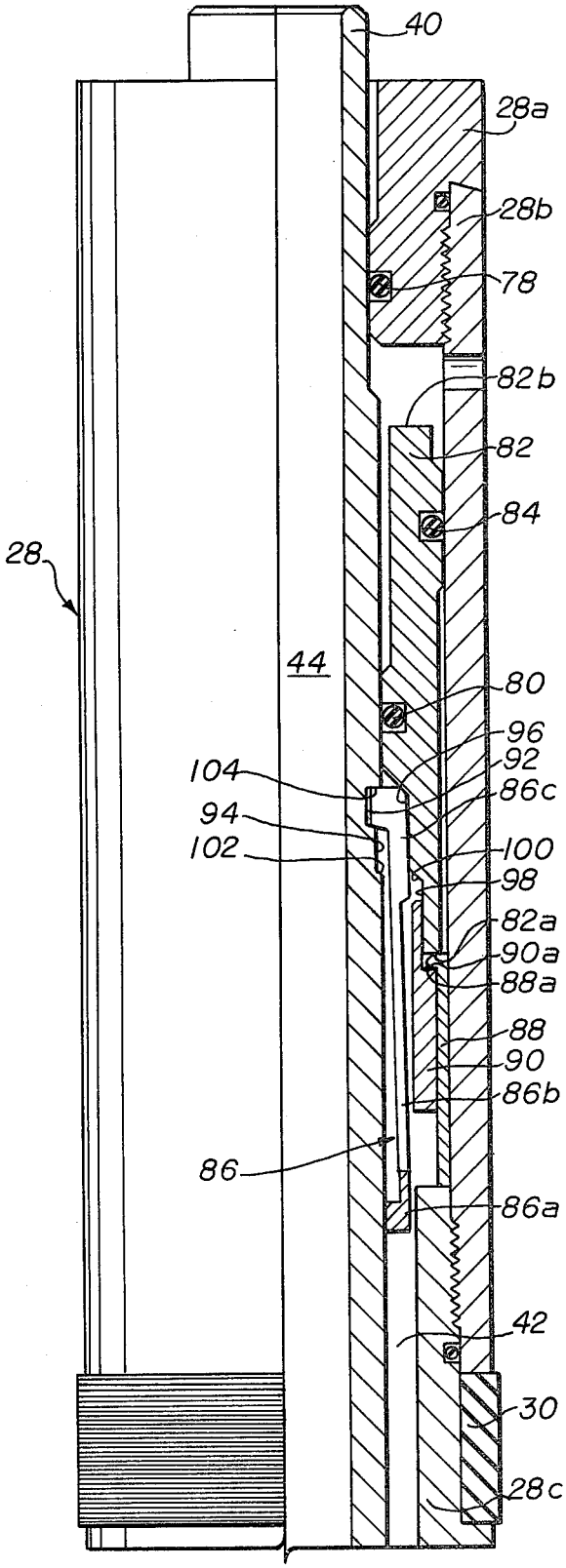
FIG. 6 is another view of the upper portion of the valve of FIG. 1 illustrating another sequential step in valve closure.

The sequential movement of operator means 40 from its second position to its first position is illustrated in FIGS. 4 through 6.

During movement of operator means 40 from its second position to its first position, the collet heads 86c are held in engagement with the first recess step 92 of operator means 40. The collet heads 86c are held confined in this first recess step 92 by the coaction of collar means 90 and floating piston means 82. Due to such confinement, floating piston means 82 remains disassociated from operator means 40 and is not pushed upwardly.

During the initial movement of operator means 40 from its second piston (see FIG. 4), collar means 90 engages and confines the collet heads 86c. Collar means 90 is moved axially with respect to valve housing means 28 due to its engagement with the collet heads 86c. A lip 88a of stop means 88 may be provided to engage an annular shoulder 90a of collar means 90 and stop the upward axial movement of collar means 90 (see FIG. 5).

Operator means 40 continues its upward movement. Although collar means 90 is stopped, due to the length of the collet heads 86c, collar means 90 continues to confine the collet heads 86c inwardly. The collet heads 86c remain engaged with the first recess step 92. Collet means 86 moves upwardly with operator means 40. The collet heads 86c span the second stepped shoulder 98 of floating piston means 82. A portion of the collet heads 86c becomes lodged under the first shoulder 96 of floating piston means 82 while another portion of is still lodged under sleeve means 90 (see FIG. 5).

Operator means 40 continues its upward movement to its first position. The collet heads 86c remain confined in the first recess step 92 of operator means 40 and slide along the first stepped shoulder 96 of floating piston means 82. Operator means 40 completes its upward movement to its first position prior to the time that the collet heads 86c engage the body portion of floating piston means 82.

Therefore, the entire extent of upward axial movement of operator means 40 from its second position to its first position occurs without movement of floating piston means 82. Residual pressurized control fluid within control pressure chamber means 72 will therefore be effective across only the first pressure responsive area. Since that first pressure responsive area is a small area, a smaller fluid force, vis-a-vis present safety valves, retards movement of operator means 40 to its first position. Spring means 70 may therefore easily store the energy to generate this moving force.

Even though operator means 40 has been returned to its first position, the subsurface safety valve 16 is not ready to be used to again open the subsurface flow path. The collet heads 86c remain confined between the first recess step 92 of operator means 40 and the first stepped shoulder 96 of floating piston means 82. Prior to opening the subsurface flow path, floating piston means 82 is moved upwardly so that the collet heads 86c may spring radially outwardly and disengage from the first recess step 92. To move floating piston means 82 upwardly, fluid within the tubing bore is pressurized. The pressurized fluid communicates through port means 68 to the lower pressure responsive area of floating piston means 82. When the pressure of fluid within the tubing bore is greater than the hydrostatic pressure of control fluid within control conduit means 24, floating piston means 82 will be moved upwardly until its upper end 82b engages the upper end of pressure chamber means 76. When floating piston means 82 has been moved to that position, the collet heads 86c spring outwardly and engage the second step shoulder 98 of floating piston means 82. Thereafter, when control pressure chamber means 76 is pressurized, floating piston means 82 will move downwardly without affecting movement of operator means 40 until the collet heads 86c engage the upward facing shoulder 102 of the second recess step 94. When the collet heads 86c has so engaged the second recess step 94, the opening sequential operation of the subsurface safety valve 16 may proceed as previously described.

Figure 7:
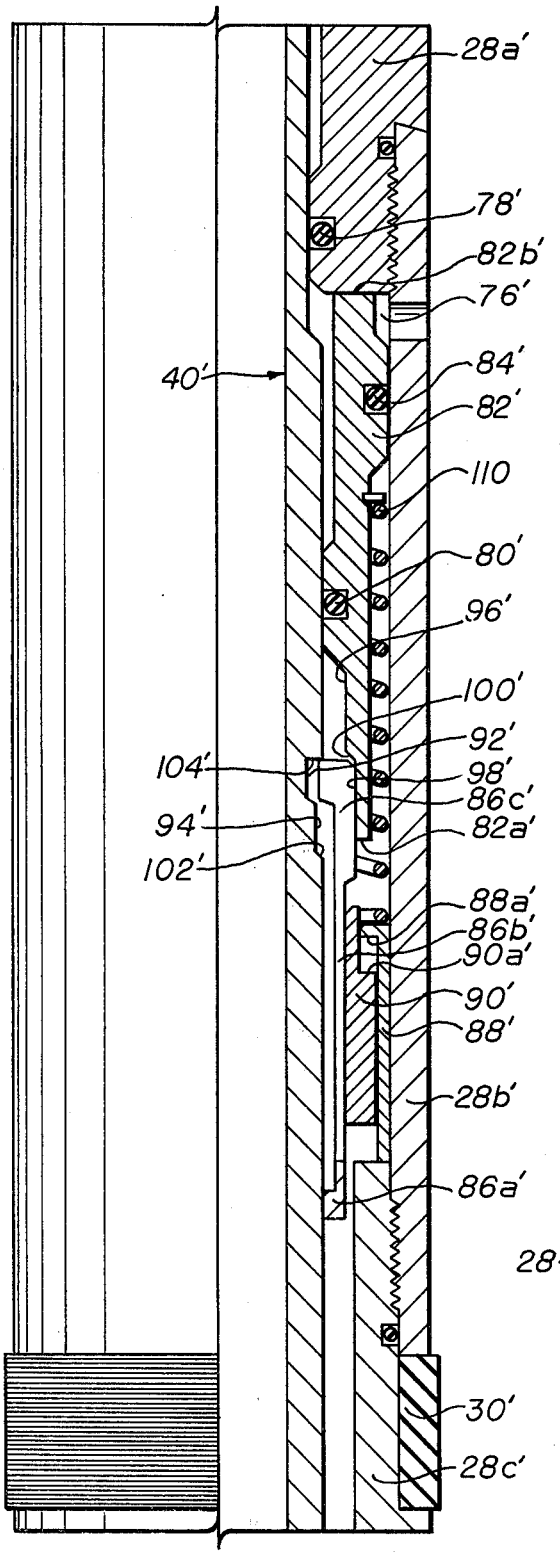
FIG. 7 is a quarter-sectional view of the upper portion of a second embodiment of this invention.

FIG. 7 illustrates a portion of an alternate embodiment of a subsurface safety valve 16' constructed in accordance with this invention. The alternate embodiment 16' includes a positive means for yieldably urging floating piston means upwardly during and after valve closure. Except for this additionally yieldable urging means 110, other components of the subsurface safety valve 16' correspond to components previously described. They have been designated with corresponding numerals except for the addition of a '.

The yieldable urging means 110 may comprise a coil compression spring disposed between stop means 88' and a shoulder 112 of floating piston means 82'.

The operation of this alternate embodiment of a subsurface safety valve 16' is similar to the operation of a subsurface safety valve 16 previously described. The difference in operation occurs during valve closure. Operator means 40' is preferably returned to its first position prior to upward movement of floating piston means 82' within pressure chamber means 76'. (Movement of operator means 40' prior to movement of floating piston means 82' is preferred to reduce the fluid inertia and fluid friction forces previously described.) At that time, the collet heads 86c' remain confined between the first recess step 92' of operator means 40' and the first stepped shoulder 96' of floating piston means 82'. Upon a further reduction of fluid pressure within control pressure chamber means 76', and if necessary, a pressurization of fluid within the tubing string, spring means 110 will move floating piston means 82' upwardly. Upon such movement, the collet heads 86' will spring radially outwardly and engage the second stepped shoulder 98'. Thereafter, the alternate embodiment of a subsurface safety valve may be operated in the manner previously described for the first embodiment to open the subsurface flow path.

From the foregoing it can be seen that the objects of this invention have been obtained. A subsurface safety valve, incorporating an equalizing valve and a main valve, has been provided with two pressure responsive areas. During opening of the subsurface flow path, a large pressure responsive area is effective until the equalizing valve is opened. Thereafter, a small pressure responsive area is effective to open the main valve. The large pressure responsive area is thus effective when forces resisting opening of the safety valve are greatest. Additionally, the conversion from a large pressure responsive area to a small pressure responsive area during opening of the subsurface flow path provides a positive indication to the surface operator that the equalizing valve has been opened. During closure of the subsurface flow path, there will be residual control fluid due to the hydrostatic head of fluid within the control conduit, retarding valve closure. However, the residual control fluid is effective across only the small pressure responsive area. The large pressure responsive area does not retard valve closure at any time. Therefore, valve closure is swifter and more assured even in the absence of well fluid pressure assistance for closure.

The foregoing description and disclosure of this invention is illustrative and explanatory thereof. Various changes in the size, shape, and materials, as well as in the details of the illustrated construction, may be made within the scope of the appended claims, without departing from the spirit of the invention.

What is claimed is:

1. A subsurface safety valve comprising:

housing means having a longitudinal bore extending therethrough;

main valve member means disposed in said bore and movable between a first, bore closing position and a second, full bore opening position;

operator means for moving said main valve member means between its first and second positions, disposed in said bore so that an annulus is formed between said operator means and said housing means, having a flow path extending therethrough, and movable between a first position wherein said main valve means is in its first position and a second position wherein said main valve means is in its second position;

means for mounting said main valve member means so that upon movement of said operator means from its first position to its second position there is an intermediate position of said operator means wherein said main valve member means remains in a bore closing position;

port means communicating between the flow path through said operator means on said one side of said main valve members means and the annulus between said valve housing means and said operator means;

equalizing valve means associated with one of said operator means and said mounting means for controlling flow through said port means, said equalizing valve means preventing flow through said port means when said operator means is in its first position and permitting flow through said port means upon movement of said operator means to its intermediate position;

means for resiliently urging said operator means to its first position;

pressure responsive means for urging said operator means to its second position, said pressure responsive means including:

a pressure chamber, a single conduit providing pressure fluid flow communication between said pressure chamber and a source of pressure fluid, a first pressure responsive area for moving said operating means from its first position to its second position when said pressure chamber is pressurized, said first pressure responsive area being associated with said operator means and defining a portion of said pressure chamber, a second pressure responsive area for assisting movement of said operator means from its first position to its intermediate position when said pressure chamber is pressurized, said second pressure responsive area defining a portion of said pressure chamber and being associated with said operator means during movement thereof from its first position to its intermediate position and being disassociated from said operator means during movement thereof from its intermediate position to its second position and from its second posititon to its first position.

2. A subsurface safety valve comprising:

housing means having a bore extending therethrough;

closure means for controlling flow through said housing bore and including:

main valve member means movable between a bore closing position and a full open bore position, and equalizing valve means movable between a position preventing flow and a position permitting flow around said main valve means;

means for mounting said closure means so that when said closure means is in a first position said main valve member means and said equalizing valve means prevent flow, when said closure means is in an intermediate position said main valve member means is in a bore closing position and said equalizing valve means permits flow around said main valve means, and when said closure means is in a second position said main valve member means is in its full open bore position;

operator means for controlling movement of said closure means;

means for resiliently urging said operator means to a first position wherein said closure means is in its first position; and pressure responsive means for moving said operator means to a second position wherein said closure means is in its second position, said pressure responsive means including:

a pressure chamber, a single conduit providing pressure fluid flow communication between said pressure chamber and a source of pressure fluid, primary piston means for moving said operator means from its first position to its second position when said pressure chamber is pressurized, said primary piston means being associated with said operator means and defining a portion of said pressure chamber, and floating piston means for assisting movement of said operator means from its first position to its intermediate position wherein said closure means is in its intermediate position when said pressure chamber is pressurized, said floating piston means defining a portion of said pressure chamber, means for rendering said floating piston means effective for assisting movement of said operator means from its first position to its intermediate position;

means for rendering said floating piston means ineffective for assisting movement of said operator from its intermediate position to its second position; and means for preventing said means for rendering said floating piston means effective from moving said floating piston means during movement of said operator means from its second position to its first position.

3. A subsurface safety valve of claim 2 wherein:

said floating piston means moves between its first position and its second position to assist movement of said operator means from its first position to its intermediate position; and said means for rendering said floating piston means ineffective includes stop means for stopping axial movement of said floating piston means when it reaches its second position.

4. The subsurface safety valve of claim 3 additionally including:

means for yieldably urging said floating piston means to its first position.

5. A subsurface safety valve comprising:

housing means having a bore extending therethrough;

main valve member means disposed in said bore and movable between a first, bore closing position and a second, full open bore position;

operator means for moving said main valve member means between its first and second positions, disposed in the bore of said housing so that an annulus is formed between said operator means and said housing means, having a flow path extending therethrough, and movable between a first position wherein said main valve member means is in its first position and a second position wherein said main valve member means is in its second position;

means for mounting said main valve member means so that upon movement of said operator means from its first position to its second position there is an intermediate position of said operator means wherein said main valve member means remains in a bore closing position;

port means communicating between the flow path through said operator means on one side of said main valve member means and the annulus between said valve housing means and said operator means;

equalizing valve means associated with one of said operator means and said mounting means for controlling flow through said port means, said equalizing valve means preventing flow through said port means when said operator means is in its first position and permitting flow through said port means after said operator means has been moved to said intermediate position;

means for resiliently urging said operator means to its first position;

pressure responsive means for urging said operator means to its second position, said pressure responsive means including:

pressure chamber means formed in the annulus between said valve housing means and said operator means, primary piston means for moving said operator means from its first position to its second position when said pressure chamber means is pressurized, said primary piston means being associated with said operator means and defining a portion of said pressure chamber means, floating piston means for assisting movement of said operator means from its first position to its intermediate position when said pressure chamber means is pressurized, disposed in said annulus, and defining a portion of said pressure chamber means, means for rendering said floating piston means effective to assist said primary piston means in moving said operator means from its first position to its intermediate position;

means for rendering said floating piston incapable of assisting movement of said operator from its intermediate position to its second position; and means for rendering said floating piston means incapable of interferring with movement of said operator means from its second position to its first position.

6. A subsurface safety valve of claim 5 wherein:

said floating piston means moves between its first position and its second position to assist movement of said operator means from its first position to its intermediate position; and said means for rendering said floating piston means incapable of assisting movement of said operator means includes stop means for stopping axial movement of said floating piston means when it reaches its second position.

7. The subsurface safety valve of claim 5 additionally including:

means for yieldably urging said floating piston means to its first position.

8. A substrate safety valve comprising:

housing means having a bore extending therethrough;

closure means for controlling flow through said housing bore and including:

main valve member means movable between a first bore closing position and a second full open bore position, and equalizing valve means movable between a first position preventing flow and a second position permitting flow around said main valve member means;

means for mounting said closure means so that when said closure means is in a first position, said main valve member means and said equalizing valve means prevent flow, when said closure means is in an intermediate position said main valve member means is in a bore closing position and said equalizing valve means permits flow around said main valve means, and when said closure means is in a second position said main valve member means is in its full open bore position;

operator means for controlling movement of said closure means;

means for resiliently urging said operator means to a first position wherein said closure means is in its first position;

pressure responsive means for moving said operator means to a second position wherein said closure means is in its second position, said pressure responsive means including:

pressure chamber means, first pressure responsive area for moving said operator means from its first position to its second position when said pressure chamber means is pressurized, said first pressure responsive area being associated with said operator means and defining a portion of said pressure chamber means, and floating piston means for assisting movement of said operator means from its first position to its intermediate position wherein said closure means is in its intermediate position;

means for selectively engaging said operator means and said floating piston means so that both said first pressure responsive area and said floating piston means are effective to move said operator means from its first position to its intermediate position;

stop means for stopping said floating piston means once said operator means reaches its intermediate position and thereby disengaging said selective engaging means from at least one of said floating piston means and said operator means; and means for preventing said selective engaging means from reengaging at least one of said operator means and said floating piston means during movement of said operator means from its second position to its first position.

9. A subsurface safety valve of a claim 8 wherein:

said floating piston means is movable between its first position and its second position to assist movement of said operator means from its first position to its intermediate position and remains in its second position during movement of said operator means from its second position to its first position; and additionally including means for yieldably urging said floating piston means to its first position.

10. A subsurface safety valve comprising:

housing means having a bore extending therethrough; main valve member means disposed in said bore and movable between a first, bore closing position and a second, full bore opening position;

operator means for moving said main valve member means between its first and second positions, disposed in the housing bore so that an annulus is formed between said operator means and said housing means, having a flow path extending therethrough, and movable between a first position wherein said main valve member means is in its first position and a second position wherein said main valve member means is in its second position;

means for mounting said main valve member means so that upon movement of said operator means from its first position to its second position there is an intermediate position of said operator means wherein said main valve member means remains in a bore closing position;

port means communicating between the flow path through said operator means on one side of said main valve member means and the annulus between said valve housing means and said operator means;

equalizing valve means associated with one of said operator means and said mounting means for controlling flow through said port means, said equalizing valve means preventing flow through said port means when said operator means is in its first position and permitting flow through said port means after said operator means has been moved to said intermediate position;

means for resiliently urging said operator means to its first position;

pressure responsive means for urging said operator means to its second position, said pressure responsive means including:

pressure chamber means formed in said annulus, primary piston means carried by said operator means and defining a portion of said pressure chamber means for moving said operator means from its first position to its second position when said chamber means is pressurized, and floating piston means disposed in said annulus, defining a portion of said pressure chamber means and axially movable within said annulus for assisting said primary piston means in moving said operator means from its first position to said intermediate position;

stop means for stopping the axial movement of said floating piston means when said operator means is moved to said intermediate position;

means for selectively engaging both of said operator means and said floating piston means so that both of said primary piston means and said floating piston means are effective to move said operator means from its first position to said intermediate position; and means for preventing said selective engaging means from re-engaging said floating piston means until said operator means is moved to its first position.

11. A subsurface safety valve of claim 10 wherein:

said floating piston means is movable between its first position and its second position to assist movement of said operator means from its first position to its intermediate position and remains in its second position during movement of said operator means from its second position to its first position; and additionally including means for yieldably urging said floating piston means to its first position.

12. A subsurface safety valve comprising:

housing means having a bore extending therethrough;

closure means for controlling flow through said housing bore and including:

main valve member means movable between a bore closing position and a full open bore position, and equalizing valve means movable between a position preventing flow and a position permitting flow around said main valve means;

means for mounting said closure means so that when said closure means is in a first position said main valve member means and said equalizing valve means prevent flow, when said closure means is in an intermediate position said main valve means member is in a bore closing position and said equalizing valve means permits flow around said main valve member means, and when said closure means is in a second position said main valve member means is in its full open bore position;

operator means for controlling movement of said closure means;

means for resiliently urging said operator means to a first position wherein said closure means is in its first position; and pressure responsive means for moving said operator means to a second position wherein said closure means is in its second position, said pressure responsive means including:

pressure chamber means, first piston means for moving said operator means from its position to its second position, when said pressure chamber means is pressurized said first piston means being associated with said operator means and defining a portion of said pressure chamber means, floating piston means for assisting the movement of said operator means from its first position to its intermediate position when said pressure chamber means is pressurized, said floating piston means defining a portion of said pressure chamber means;

said operator means including outer stepped recess means having a first recess step of a first outside diameter and a second recess step of a second outside diameter;

said floating piston means including inwardly facing stepped shoulder means having a first shoulder of a first inside diameter and a second shoulder of a second inside diameter;

means for selectively engaging one of said first and second recess steps and one of said first and second shoulders during movement of said operator means from its first position to its second position when said pressure chamber means is pressurized;

stop means for stopping said floating piston means when said operator means reaches its intermediate position;

said selective engaging means engaging the other of said first and second recess steps and disengaging from said floating piston means during movement of said operator means from its intermediate position to its second position;

means for maintaining said selective engaging means engaged with the other of said first and second recess steps and for preventing said selective engaging means from engaging said one of said first and second shoulders during movement of said operator means from said second position to said first position.

13. A subsurface safety valve of claim 12 wherein:

said floating piston means is movable between its first position and its second position to assist movement of said operator means from its first position to its intermediate position and remains in its second position during movement of said operator means from its second position to its first position; and additionally including means for yieldably urging said floating piston means to its first position.

* * * * *